US005713492A

United States Patent [19]

DeGennaro

[11] Patent Number: 5,713,492

[45] Date of Patent: Feb. 3, 1998

[54] MOUTHWASH DISPENSING DEVICE

[75] Inventor: Michael DeGennaro, Larchmont, N.Y.

[73] Assignee: Consumer Promotions, Inc., Mt. Vernon, N.Y.

[21] Appl. No.: 558,836

[22] Filed: Nov. 15, 1995

[51] Int. Cl.[6] ..... B67D 5/06

[52] U.S. Cl. ..... 222/153.03; 222/156; 222/185.1; 222/192; 222/448; 222/449; 222/453

[58] Field of Search ..... 222/153.03, 155, 222/156, 181.3, 185.1, 192, 444, 448, 449, 451, 453

[56] References Cited

U.S. PATENT DOCUMENTS

| | | | |
|---|---|---|---|
| 3,128,915 | 4/1964 | Matter | 222/156 |
| 3,604,592 | 9/1971 | Bacon et al. | 222/192 X |
| 4,210,263 | 7/1980 | Bos | 222/449 |
| 4,570,827 | 2/1986 | Roggenburg, Jr. et al. | 222/181.2 X |
| 5,019,250 | 5/1991 | Lorenzen | 222/453 X |
| 5,253,786 | 10/1993 | Schmidt | 222/153.03 |
| 5,386,930 | 2/1995 | Shani | 222/448 X |
| 5,452,825 | 9/1995 | Comstock et al. | 222/153.03 X |
| 5,454,492 | 10/1995 | Hunter et al. | 222/192 X |
| 5,529,219 | 6/1996 | Ward | 222/156 |

*Primary Examiner*—Joseph Kaufman
*Attorney, Agent, or Firm*—Bauer & Schaffer

[57] ABSTRACT

The mouthwash dispensing device includes a frame having first and second reservoirs secured thereto, the first reservoir having a first port and the second reservoir having a second port, the first and second reservoirs adapted to contain mouthwash therein. A valve assembly is associated with the first and second reservoirs for selectively gating the first and second ports. An actuating assembly is associated with the valve for opening and closing the ports to release mouthwash from the reservoirs in response to user manipulation. The frame is adapted to store both drinking cups and a bottle of mouthwash therein. A locking cover is provided to restrict access to the stored cups and mouthwash.

8 Claims, 9 Drawing Sheets 28
100
28
100
16
106
10
110
50
110
46
102
42
106
102
54
56
52
14
48
30
32
36
A
B
37
40
88
104
90
24
12
20
18
22

MOUTHWASH DISPENSING DEVICE

FIELD OF THE INVENTION

The present invention relates generally to a device for storing and dispensing mouthwash and, more particularly, to a device for repetitive dispensing of a predefined dose of mouthwash.

BACKGROUND OF THE INVENTION

Oral hygiene is an important aspect of everyday life and typically includes the brushing and flossing of teeth. Over recent years, the use of mouthwash as an oral rinse has also become part the daily routine of many people.

Mouthwash traditionally is available to the consumer in various size plastic bottles. The bottles, due to their less than stylish design and appeal, are often stored by the user in a concealed location such as a bathroom cabinet. When the user desires to rinse with the mouthwash, he must first locate the bottle of mouthwash, then either pour a quantity of the mouthwash into an available drinking container, or simply take a swig from the bottle. Unfortunately, a suitable drinking container is not always readily available, and when available, not clean as a result of not having been properly washed after a previous use. When a suitable drinking container is located by the user, the user often fills the container with an incorrect dosage of the mouthwash resulting in either an incomplete rinsing of the mouth or the wasting of mouthwash.

In response to the above mentioned problems, some of the manufacturers of mouthwash have dimensioned the caps on the mouthwash bottles to contain a proper dosage of mouthwash. Unfortunately, the cap must be placed back on the bottle subsequent to being used as a drinking container. This reuse of the cap typically results in an unwashed cap being placed back onto the bottle and reused multiple times without ever being washed. The problems associated with using the cap as a drinking container become compounded when multiple users are drinking from the same cap.

The present invention overcomes the above-described problems by providing a mouthwash dispensing device which stores both mouthwash and disposable drinking containers, and which effectively dispenses a proper dose of mouthwash into one the drinking containers in response to user manipulation. Thus, the mouthwash dispensing device of the present invention will accurately dispense a proper dose of mouthwash into a disposable drinking container in a sanitary manner.

Another practical advantage of the present invention is that the mouthwash dispensing device can be conveniently placed on a counter or easily mounted to a wall. Yet another advantage of the present invention is that the device is adapted to store a quantity readily available disposable cups therein.

SUMMARY OF THE INVENTION

Briefly stated, the present invention comprises a mouthwash dispensing device for use in storing and dispensing mouthwash. In one embodiment, the device includes a frame having first and second reservoirs secured thereto. The first reservoir has a first port and the second reservoir has a second port, the first and second reservoirs adapted to contain mouthwash therein. A valve assembly is associated with the first and second reservoirs for selectively gating the first and second ports. An actuating assembly is provided which is linked to the valve assembly for moving the valve assembly between an open position wherein the first port is unobstructed and the second port is totally obstructed, and a closed position wherein the first port is totally obstructed and the second port is unobstructed. When the valve means is in the open position a predefined amount of mouthwash is dispensed from the second reservoir through the second port.

A cover is provided and is releasably secured to the frame. The cover is movable between an open position and a closed position. A lock assembly is connected to the frame and the cover for locking the cover in the closed position. The device is further equipped with mounting holes through the frame which allow the device to be readily mounted to a supporting surface, for example a wall. The device further includes a pair of tubular storage assembly mounted to the frame for storing drinking cups. The frame is equipped with a pair of bottle support members which are dimensioned and adapted to support an inverted bottle of mouthwash. The neck of the inverted bottled being positioned within the first reservoir.

The valve assembly includes a rod connected at one end to a frame member and at another end to a stopper. The valve assembly further includes a disk mounted to the rod having a plug thereon. The stopper is dimensioned to totally obstruct the second port when placed therein, the plug is dimensioned to totally obstruct the first port when placed therein.

The actuating assembly includes an inner cylinder slidably disposed within an outer cylinder, the inner cylinder connected to the frame member. The inner cylinder is movable between a resting position wherein the stopper totally obstructs the second port and the plug does not obstruct the first port, and an actuated position wherein the first port is totally obstructed by the plug and the second port is unobstructed by the stopper. The inner cylinder is movable in response to pressure exerted thereon by the drinking cup. When the user moves the inner cylinder with the use of a drinking cup, a predefined serving of mouthwash is dispensed into the drinking cup.

Full details of the present invention are set forth in the following description of the invention.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

Figure 1:
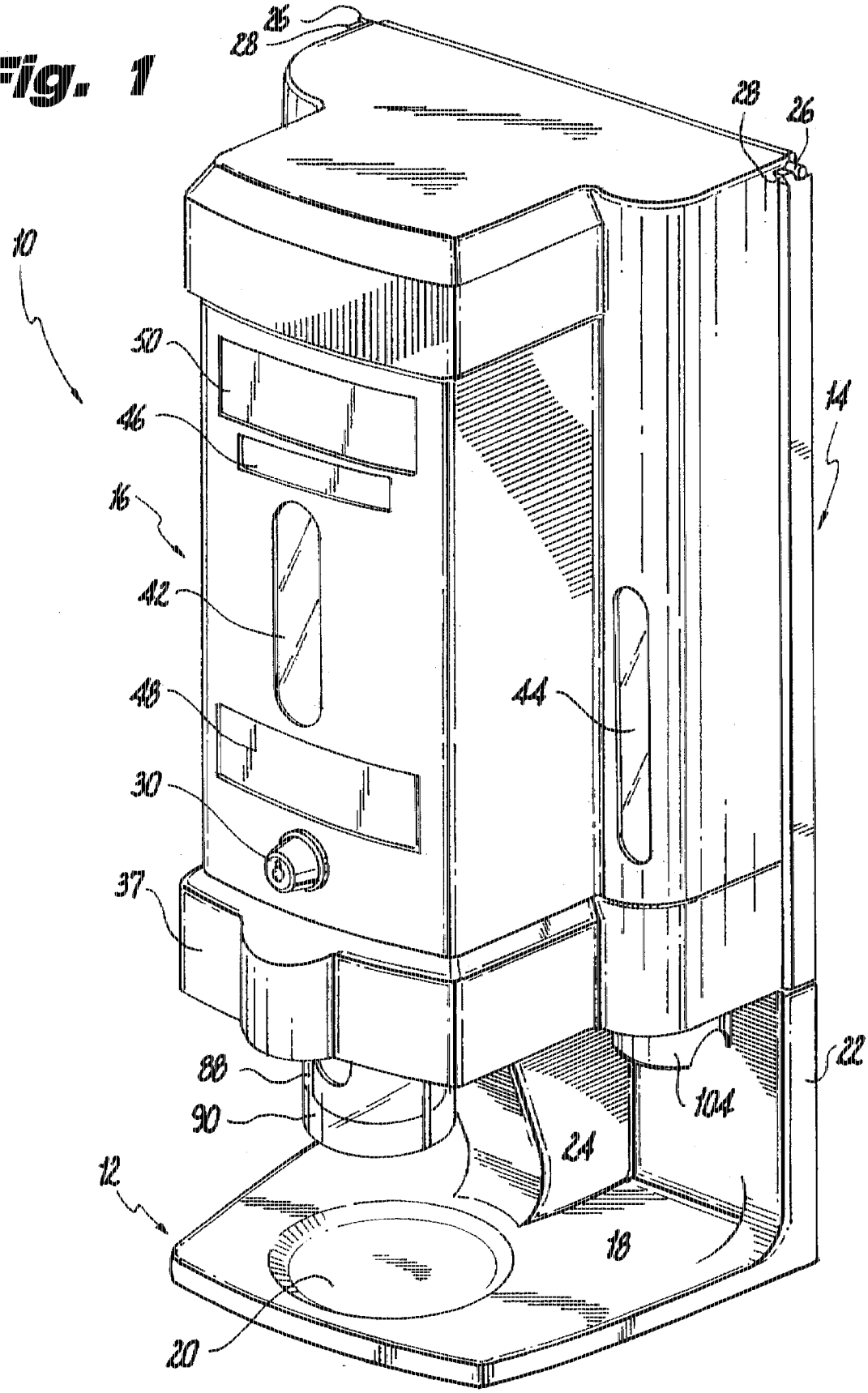
FIG. 1 is a perspective view of a mouthwash dispensing device in accordance with the teachings of the present invention.
Figure 2:
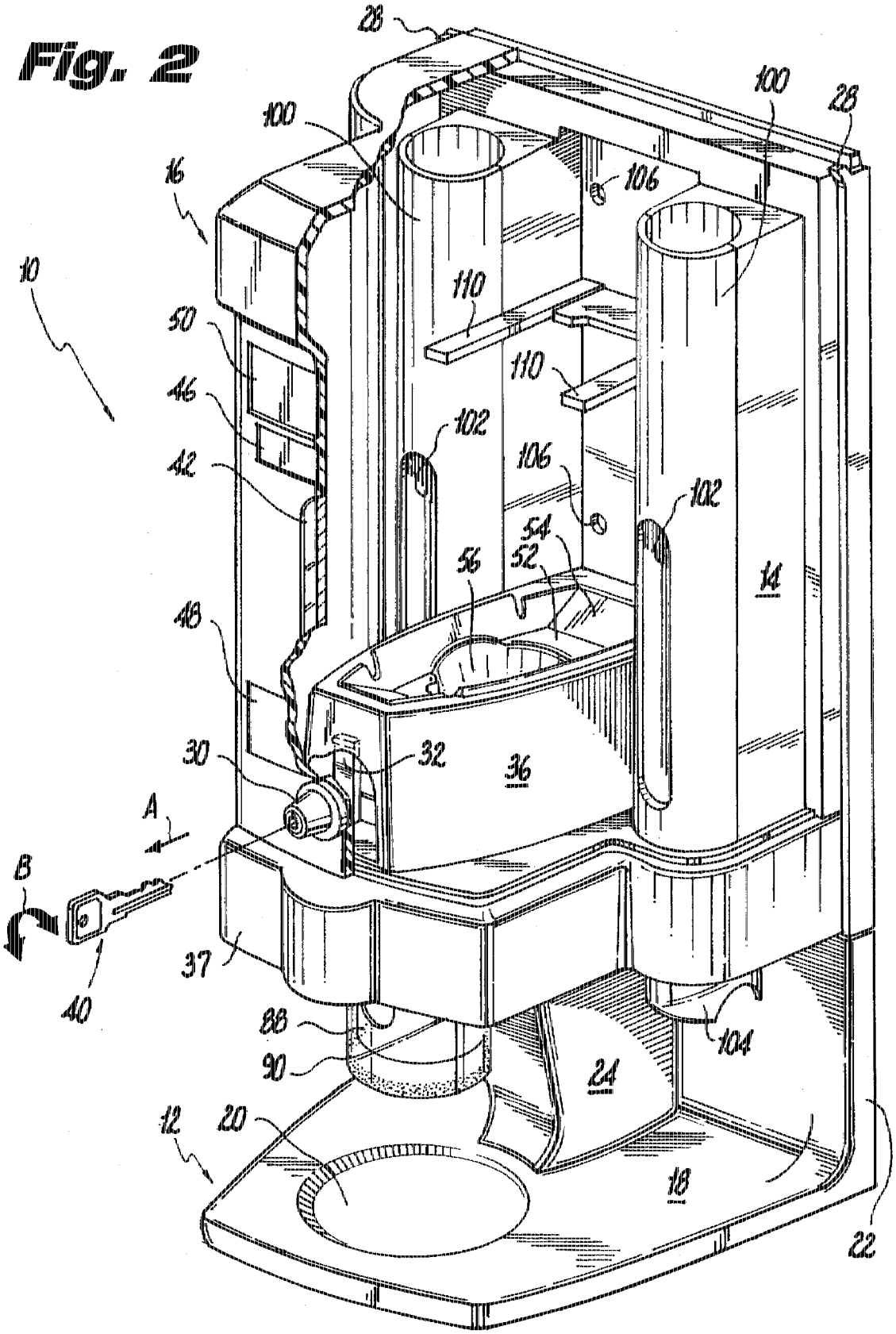
FIG. 2 is a section view of the mouthwash dispensing device shown in FIG. 1 illustrating the lock assembly.

Referring now to the drawings in detail, wherein like numerals are used to indicate like elements throughout, there is shown in FIGS. 1 and 2 a preferred embodiment of a mouthwash dispensing device, generally designated 10, in accordance with the present invention. As shown in FIG. 1, the mouthwash dispensing device 10 comprises three main structural members, namely base 12, frame 14 and cover 16.

With continued reference to FIGS. 1 and 2, base 12 is substantially L-shaped and includes a horizontal section 18. Formed within horizontal section 18 is a drip reservoir 20 configured to contain liquid which may drip during dispensing. Base 12 further includes a vertical back support 22 extending up from the horizontal section 18, as well as a center support 24 also extending upward from horizontal section 18 which, together with the vertical back support 22, serves to support frame 14 thereon.

With continued reference to FIGS. 1 and 2, cover 16 is disposed on frame 14. Axis tabs 26 extend from respective sides of cover 16 and rest against guide members 28 of frame 14 such that the cover 16 can be removed. The frame 14 is supported on the vertical back support 22 and the center support 24 of base 12. The guide members 28 at their upper end permit rotation of axis tabs 26 of cover 16 thereon while maintaining engagement between the cover 16 and the frame 14. When the user desires to access the interior of the device 10, the user can simply pull on the bottom portion of the cover 16 in a direction indicated by arrow "A" in FIG. 2, thereby rotating the axis tabs 26 on guide members 28.

Figure 6:
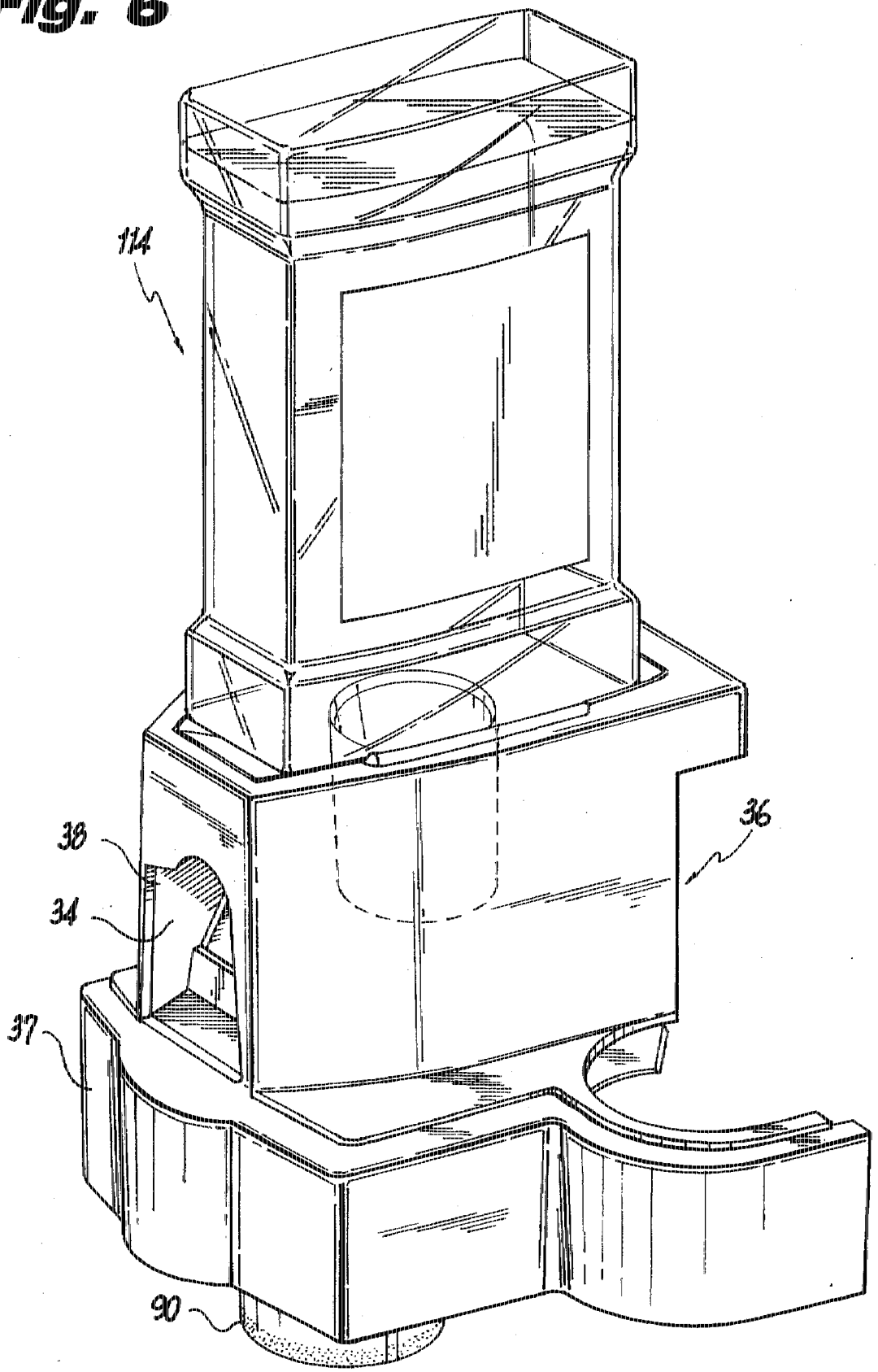
FIG. 6 is a view similar to that of FIG. 5 with the bottle inserted into the upper reservoir of the mouthwash dispensing device.

Referring once again to FIGS. 1 and 2, a lock assembly 30 is provided to prevent unauthorized access to the interior of the device 10. Lock assembly 30 is disposed through the cover 16 and includes a rotatable arm 32. Arm 32 extends generally perpendicular from the lock assembly 30 into a slot 34 in a reservoir support 36. As best seen in FIGS. 2 and 6, slot 34 is irregular in shape and includes a wide portion 38. Lock assembly 30 is movable between a locked position, as shown in FIG. 2, and an unlocked position. The lock assembly is moved between the locked and unlocked positions by rotation of key 40. Referring to FIG. 2, when in a locked position, the distal end of arm 32 is located behind a portion of the reservoir support 36, thus preventing removal of the cover 16 from the frame 14. Lock assembly 30 can be moved to an unlocked position through counter-clockwise rotation of the key 40. When the arm 32 is rotated in a counterclockwise direction, arm 32 is moved within the wide portion 38 of slot 34 wherein reservoir support 36 is no longer disposed between the arm 32 and the cover 16 permitting the unobstructed removal of the cover 16.

The cover 16 is made from a polymeric material, although other suitable materials may be used, and includes a clear plastic center window 42 is flanked on either side by clear plastic side windows 44 allowing the user to visually inspect the interior of the frame 14 to determine the level of mouth wash and the amount of cups. Upper window 46 and lower window 48 are also provided in the cover 16 which may also be used for visual inspection of the frame 14 contents, or may be used to display product information or directions on removable labels. In the preferred embodiment of the present invention as shown in FIG. 1, a label surface 50 is provided to display production identification or the like, for example, raised letters.

Figure 3:
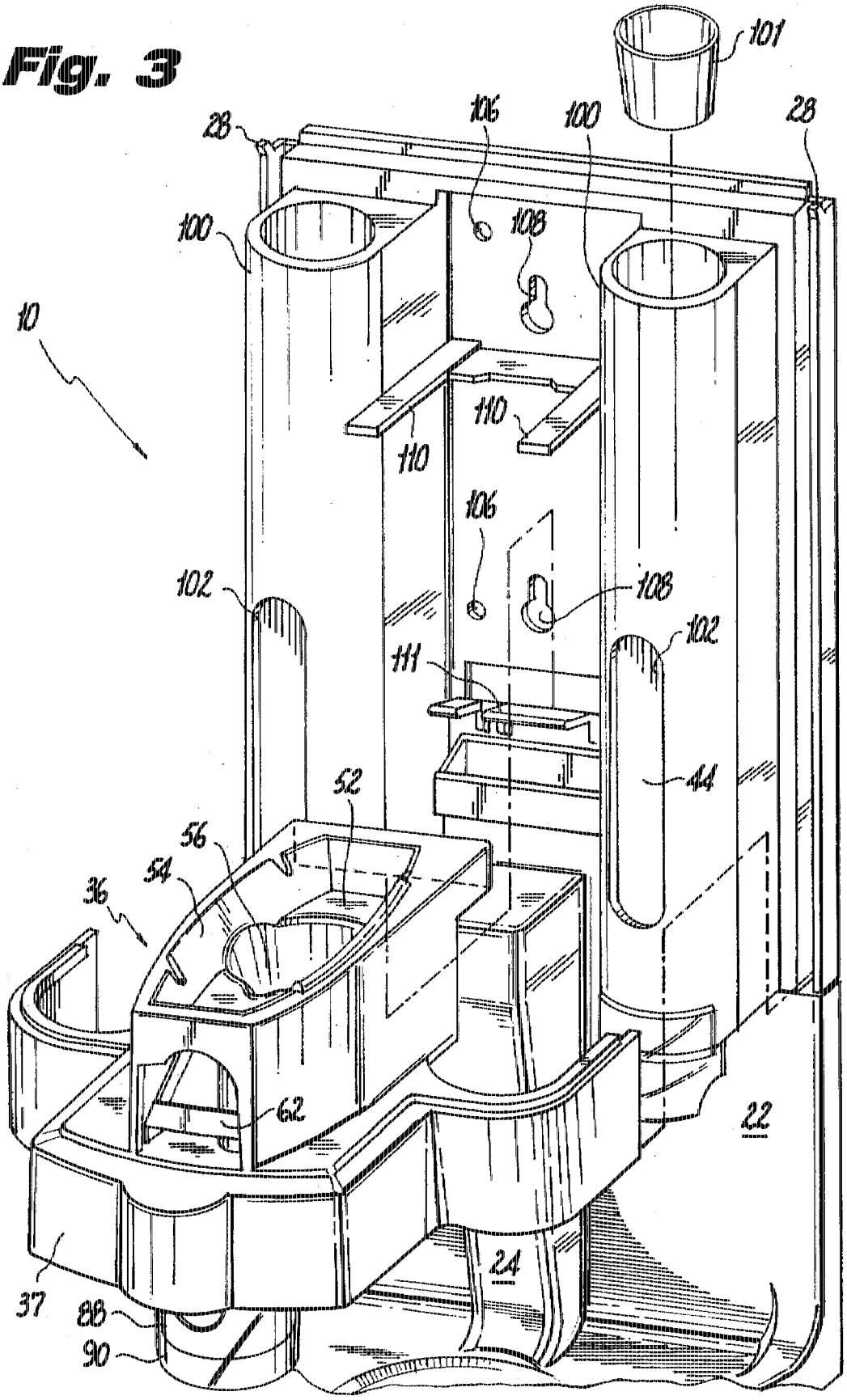
FIG. 3 is a perspective view of the mouthwash dispensing device shown in FIG. 1 with the cover removed and the reservoir support separated from the frame.
Figure 4:
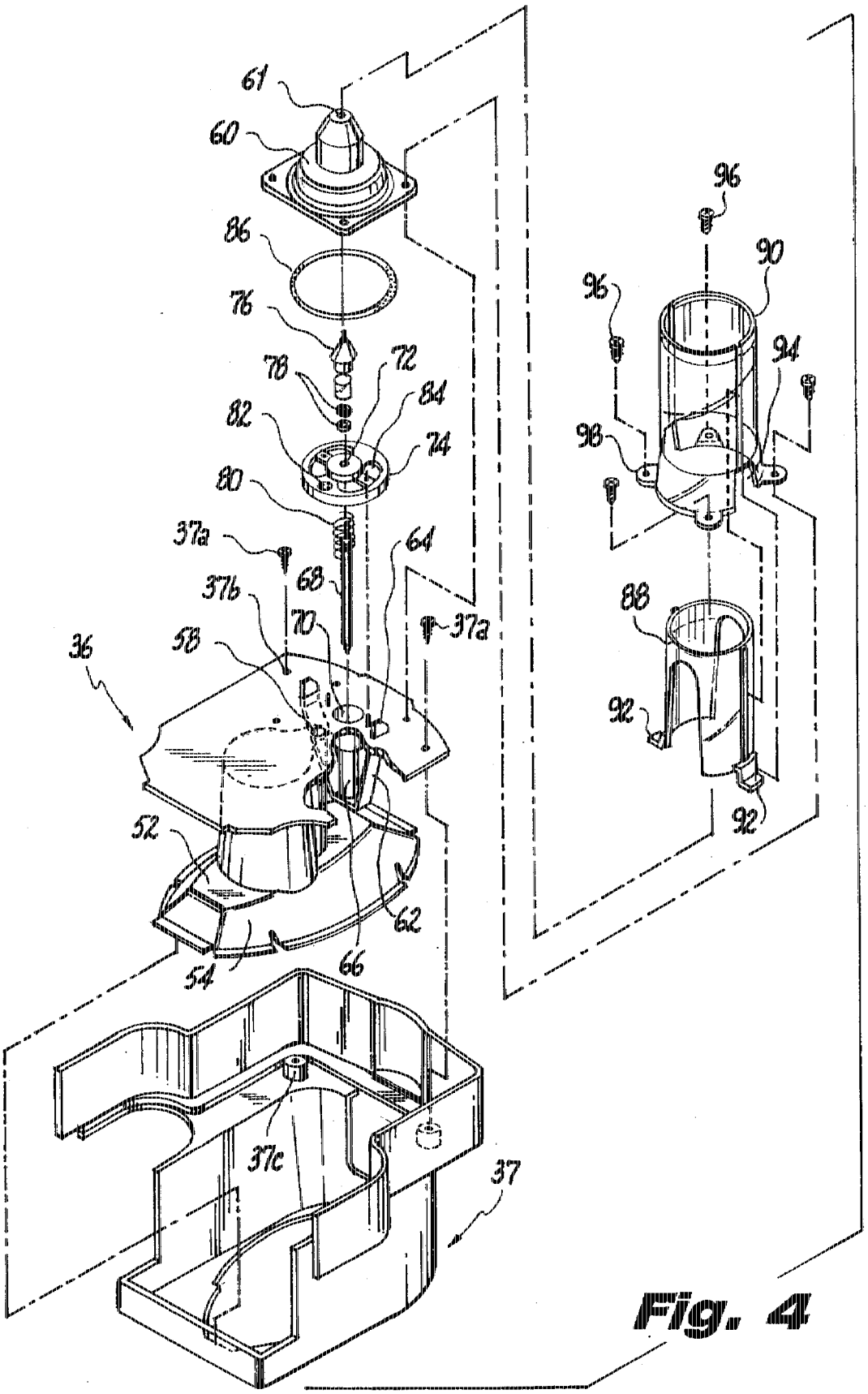
FIG. 4 is an inverted exploded view of the mouthwash dispensing device illustrating the components of the upper and lower reservoirs.

Referring now to FIGS. 2–4, the reservoir support 36 is mounted to frame support 37 by screws 37*a* which are threaded through holes 37*b* in reservoir support 36 and into nut posts 37*c* in frame support 37. A trough 52 is fitted onto reservoir support 36 and includes a plurality of sloped walls 54 circumferentially disposed around an upper reservoir 54. Sloped walls 54 are adapted to direct fluid into the upper reservoir 56. Upper reservoir 56 is dimensioned to contain a predefined amount of mouthwash and includes an orifice 58 therein. The orifice 58 is disposed in the bottom of the upper reservoir 56 and, when unobstructed, permit mouthwash to flow from within the upper reservoir 56 into the lower reservoir 60. Lower reservoir 60 also includes an orifice in the form of port 61, which when unobstructed by stopper 76, permits the flow of mouthwash out of the lower reservoir 60. The manner in which mouthwash flows throughout the device will be described in detail below.

Figure 7:
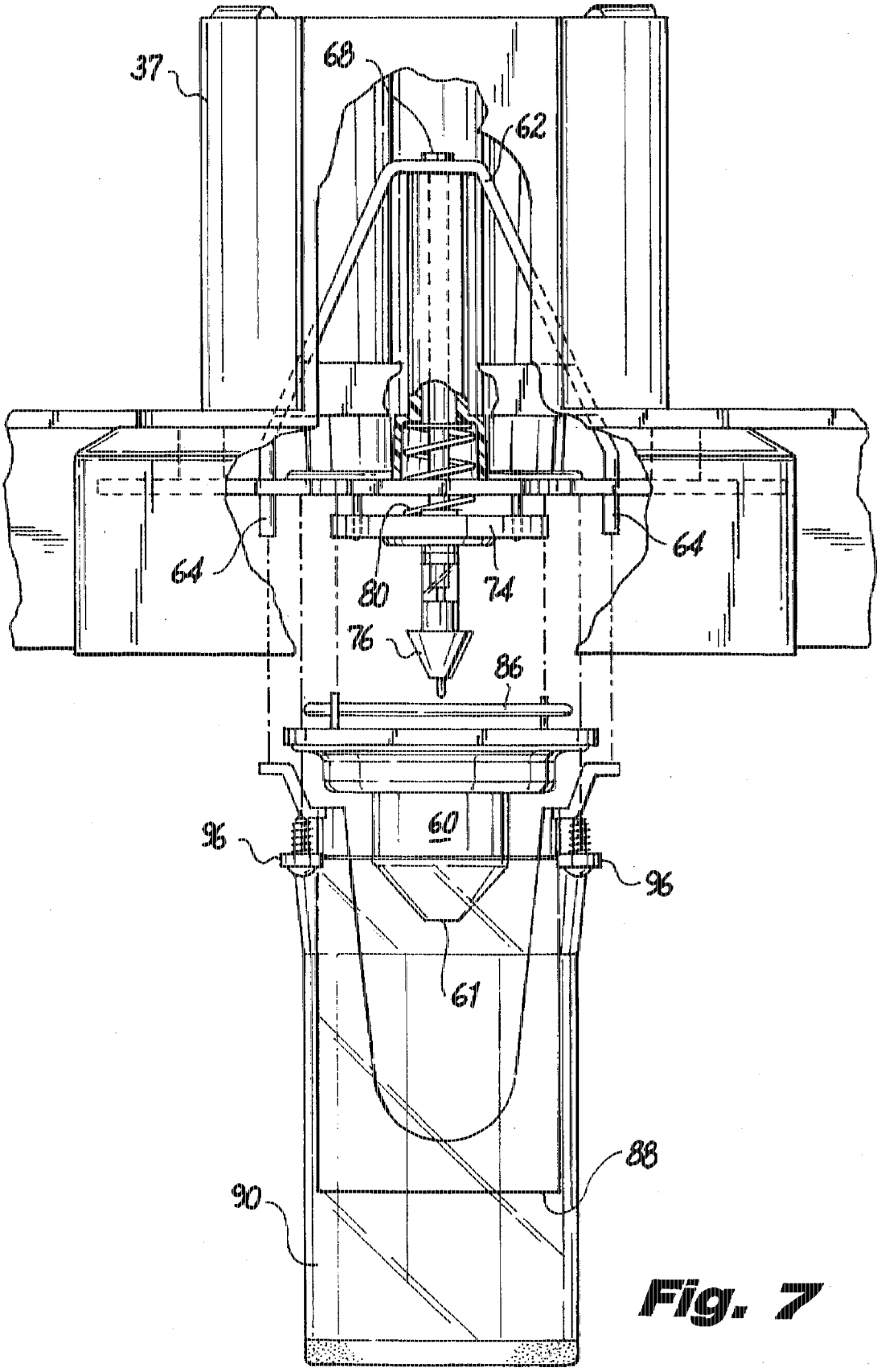
FIG. 7 is a partially sectioned view of the mouthwash dispensing device shown in FIG. 1 illustrating the device at a resting position.

Referring to FIG. 4 in conjunction with FIG. 7, A-frame member 62 defines two legs 64 which extend partially through the underside of reservoir support 36. A-frame member 62 also includes a tube 66 having an opening at one end. Rod 68 is secured at one end within tube 66 and extends through a hole 70 in reservoir support 36, through a center hole 72 in disk 74, and secured at the other end to stopper 76 by fasteners 78. Axial disposed around rod 68 is a spring 80 adapted to resist movement of rod 68 toward frame support 37. Disk 74 is fixedly secured to rod 66 and forms a plug 82. Plug 82 is dimensioned to snugly fit into orifice 58 in upper reservoir 56 when the disk 74 is moved toward the upper reservoir 56. Disk 74 includes a pair of kidney shaped openings 84 to permit the flow of fluid therethrough. An O-ring 86 is provided between lower reservoir 60 and disk 74 to prevent the leakage of fluid flowing therebetween.

With continued reference to FIGS. 4 and 7, inner cylinder 88 is slidably disposed within outer cylinder 90. Inner cylinder 88 forms a pair of oppositely facing tabs 92 which are adhered to corresponding legs 64 of A-frame member 62. Outer cylinder 90 includes a pair of notches corresponding to the placement of respective tabs 92 of the inner cylinder 88 and permit movement of the tabs 92 toward outer cylinder 90. Outer cylinder 90 is secured to reservoir support 36 by a plurality of screws 96 which pass through holes in support legs 98 of outer cylinder 90, through holes in lower reservoir 60, and through holes in reservoir support 36.

Referring to FIGS. 2–3, formed on frame 14 are a pair of spaced cup tubes 100 dimensioned to contained a plurality of stacked cups 101. Slots 102 are formed within cup tubes 100 to permit visual access of the stack of cups within the cup tubes 100. Cup extensions 104 are fitted onto the lower ends of cup tubes 100 and are dimensioned to prevent cups stored within the cup tubes 100 from falling therefrom, and to permit a user to withdraw a single cup from the cup tube 100 with minimal force. Mounting holes 106 and mounting slots 108 are formed through the back of frame 14 to permit the device 10 to be mounted to a support surface, for example, a bathroom wall. Bottle support members 110 extend horizontally from the frame 14 and are adapted to support an inverted bottle of mouthwash thereon.

Figure 5:
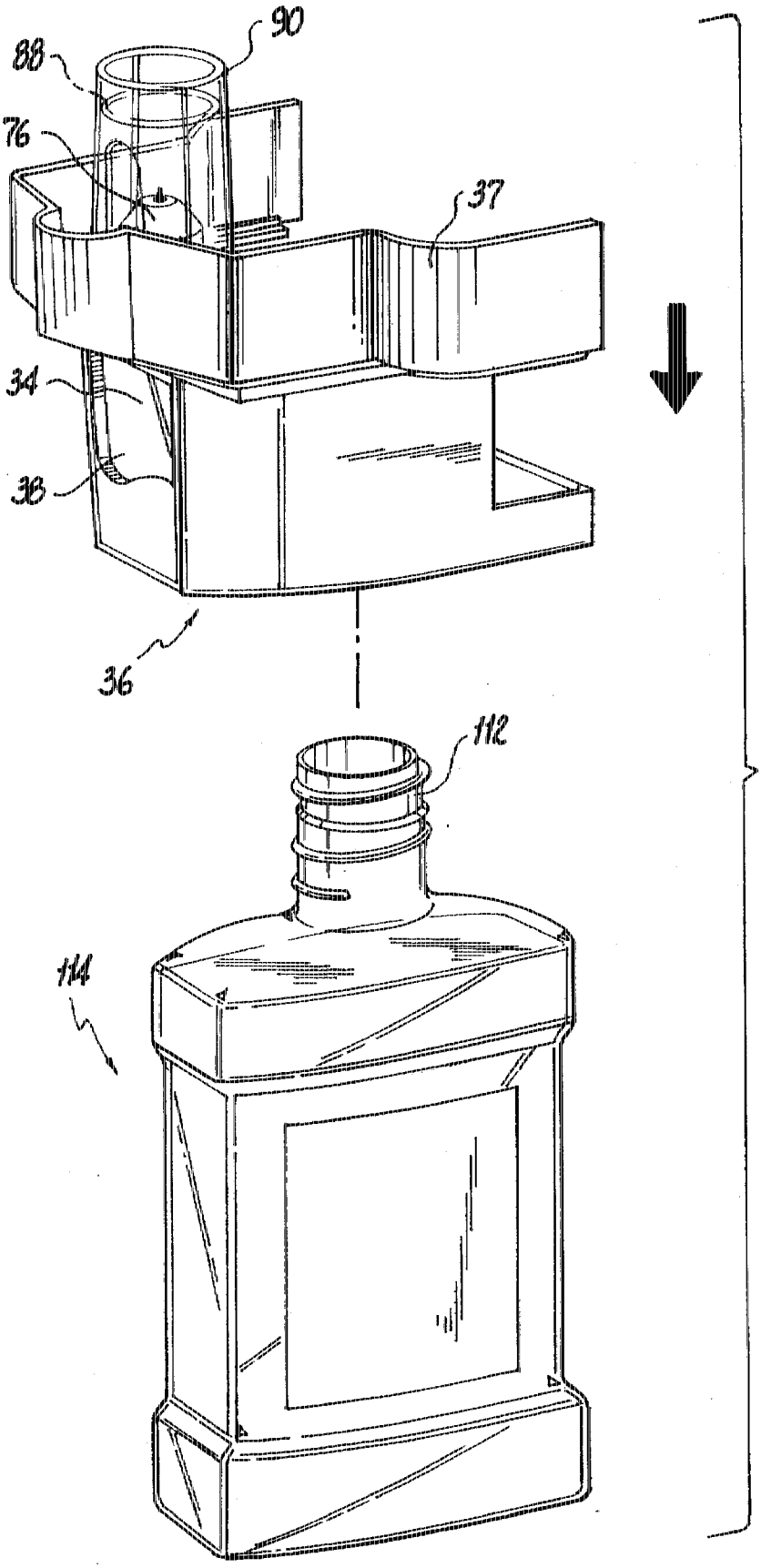
FIG. 5 is a perspective view of a bottle of mouthwash being positioned for insertion into a separated reservoir support of the mouthwash dispensing device.
Figure 8:
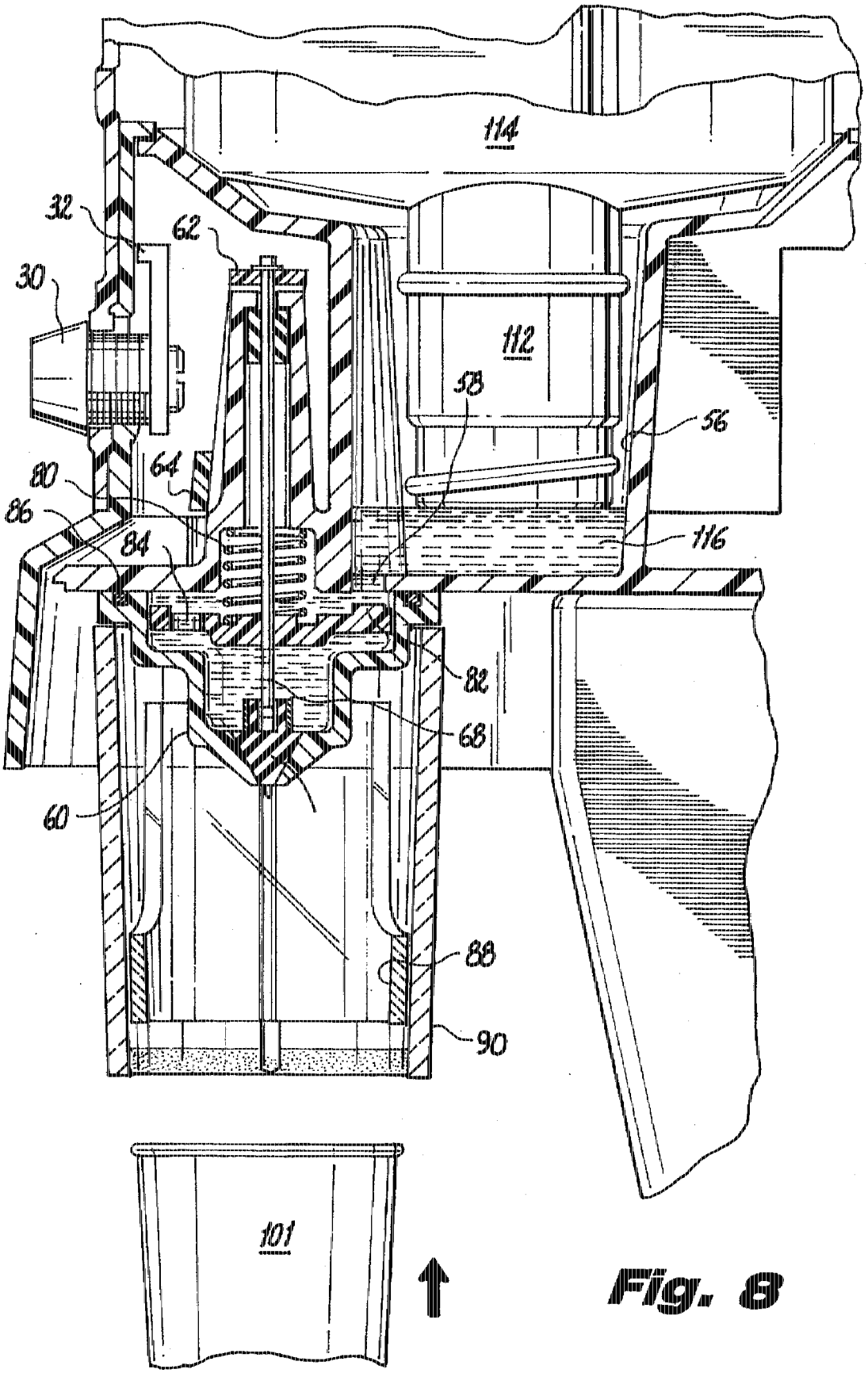
FIG. 8 is cross-sectional view of the mouthwash dispensing device shown in FIG. 1 at a resting position.
Figure 9:
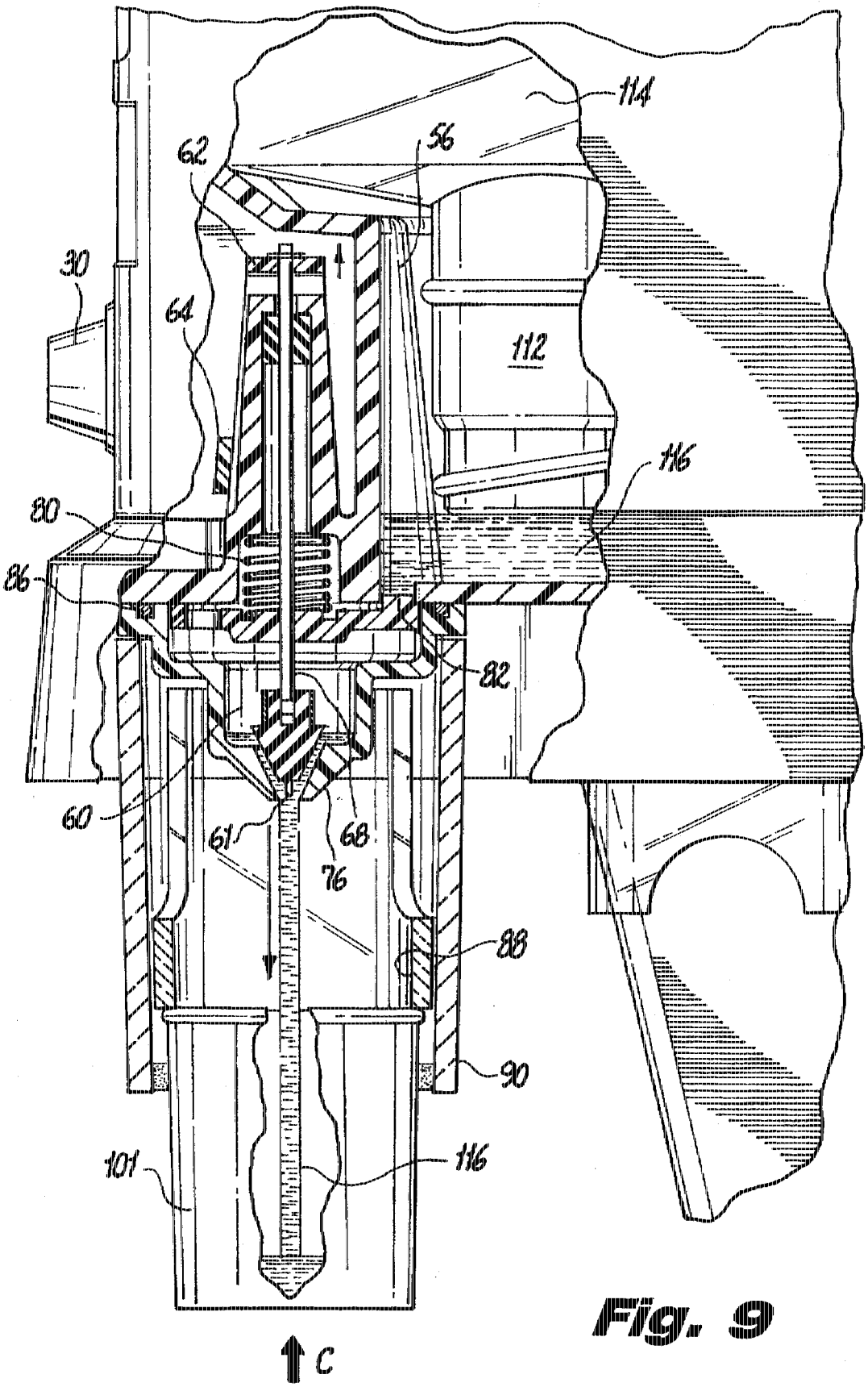
FIG. 9 is a cross-sectional view of the mouthwash dispensing device shown in FIG. 1 in an actuated position wherein mouthwash is being dispensed therefrom.

Referring to FIGS. 5–9, the operation of the device 10 will now be described. After removing the frame support 37 from the device 10 by simply lifting the frame support 37 off of ledge support 111 (see FIG. 3), the frame support 37 is inverted and placed onto the neck 112 of an open bottle 114 of mouthwash as shown in FIG. 5. With the neck 112 of bottle 114 positioned within the upper reservoir 56, the bottle 114 and frame support 37 can be turned into a position wherein the bottle 114 is inverted as shown in FIG. 6. In this resting position, the stopper 76 is urged by the force applied by the spring 80 on the rod 68 into the orifice 58 in the upper reservoir 56 thus preventing leakage of the mouthwash. The frame support 37 can then be placed back onto the frame 14 with the inverted bottled being partially supported by the bottle support members 110 as shown in FIGS. 8–9.

The user having removed a cup 101 from one of the cup tubes 100, positions the cup 101 beneath the outer cylinder 90 as shown in FIG. 8. In the resting position shown in FIG. 8, mouthwash 116 flowing from the inverted bottle 114 fills a portion of the upper reservoir 56, flows through orifice 58 which is unobstructed by plug 82, and fills lower reservoir 60. The mouthwash 116 is prevented from flowing out of the lower reservoir 60 through port 61 by stopper 76. The amount of mouthwash 116 within lower reservoir 60 is predetermined as a single serving. Referring to FIG. 9, the user can dispense the serving by moving the cup 101 in an upward direction (see arrow "C") within outer cylinder 90 and into contact with the inner cylinder 88. Once the cup 101 is in contact with the inner cylinder 88, the user applies a small amount of force on the cup 101 in direction "C", the small amount of force being greater than the amount of force that the spring 80 exerts on the rod 68. As the user applies this force on the inner cylinder 88, the inner cylinder 88 is slid upward within the stationary outer cylinder 90.

Referring to FIG. 7 in conjunction with FIG. 8, as the inner cylinder 88 moves upward, the tabs 92 of the inner cylinder 88 are placed into contact with the legs 64 of the A—A-frame member 62. Continued upward movement of the inner cylinder 88 urges the A-frame 62, and connected rod 68, upward overcoming the force of the spring 80 and lifting the connected stopper 76 out from the port 61 in the lower reservoir 60 and moving the plug 82 into the orifice 58 in upper reservoir 56. With the port 61 unobstructed, and the orifice 58 obstructed, only the single serving of mouthwash 116 contained within the lower reservoir 60 is allowed to flow out of the device 10 and into the cup 101 as shown in FIG. 9. The cup 101 is then withdrawn from the device 10 permitting the spring 80 to force the rod 68 and connected stopper 76 back into the port 61, allowing inner cylinder 88 to slide down within outer cylinder 90, and removing plug 82 from orifice 58 and allowing the process to be repeated.

Preferably, the base 12, frame 14 and cover 16 are formed of a polymeric material. However, it is understood that other material may be suitable as well. It will also be appreciated that the relative dimensions of the components of the device could be varied for example, the size of the lower reservoir could be made larger or smaller depending on the strength of the mouthwash to be dispensed. In addition, the size of the frame and bottle supports could be varied to accommodate different sized bottles.

From the foregoing description, it can be seen that the present invention comprises a mouthwash dispensing device for storing and dispensing mouthwash. It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined in the appended claims.

What is claimed is:

1. A device for use in storing and selectively dispensing defined quantities of a liquid from a supply bottle, comprising:

a frame, said frame having means for supporting a supply bottle in inverted position, said bottle having an opening through which said liquid flows outwardly;

a first reservoir mounted on said frame below said supply bottle so that the opening is situated within said first reservoir to receive liquid from said bottle when the liquid in said first reservoir falls below the opening, said first reservoir having a first outlet port;

a second reservoir mounted below said first reservoir to receive liquid from said first reservoir, said second reservoir having a second outlet port;

valve means associated with said first and second reservoirs for selectively gating said first and second ports;

actuating means associated with said valve means, said valve means being responsive to user manipulation to move between an open position wherein said first port is unobstructed and said second port is totally obstructed, and a closed position wherein said first port is totally obstructed and said second port is unobstructed;

said valve means, when in the open position, permits a predefined amount of mouthwash to be dispensed from said second reservoir through said second port and, when in the closed position, permits liquid to be replenished from said first reservoir to said second reservoir and from said bottle to said first reservoir.

2. The device according to claim 1, further including a cover releasably secured to said frame and movable between an open position for replacement of said bottle and a closed position for enclosing said bottle and said reservoirs.

3. The device according to claim 2, further including a lock assembly connected to said frame and said cover for locking said cover in the closed position.

4. The device according to claim 1, further including at least one storage assembly mounted to said frame for storing at least one drinking cup.

5. The device according to claim 1, wherein the user can actuate the actuating means with a drinking cup to dispense mouthwash into the drinking cup.

6. The device according to claim 1, further including means disposed on said frame for mounting said device onto a supporting structure.

7. The device according to claim 1, wherein said valve means includes a rod connected at one end to a frame member and at another end to a stopper, said valve means further including a disk mounted to said rod having a plug thereon, said stopper dimensioned to totally obstruct said second port when placed therein, said plug dimensioned to totally obstruct said first port when placed therein.

8. The device according to claim 1, wherein said actuating means includes an inner cylinder slidably disposed within an outer cylinder, said inner cylinder connected to said frame member, said inner cylinder movable between a resting position wherein said stopper totally obstructs said second port and said plug does not obstruct said first port, and an actuated position wherein said first port is totally obstructed by said plug and said second port is unobstructed by said stopper, said inner cylinder being movable in response to pressure exerted thereon by the drinking cup.

* * * * *